US006752484B2

(12) United States Patent
Jagannathan et al.

(10) Patent No.: US 6,752,484 B2
(45) Date of Patent: Jun. 22, 2004

(54) APPARATUS AND METHOD OF DELIVERING A BEAM OF A FUNCTIONAL MATERIAL TO A RECEIVER

(75) Inventors: Ramesh Jagannathan, Rochester, NY (US); Glen C. Irvin, Jr., Rochester, NY (US); Seshadri Jagannathan, Pittsford, NY (US); Sridhar Sadasivan, Rochester, NY (US); Suresh Sunderrajan, Rochester, NY (US); John E. Rueping, Spencerport, NY (US); Gary E. Merz, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/091,842

(22) Filed: Mar. 6, 2002

(65) Prior Publication Data

US 2002/0118246 A1 Aug. 29, 2002

Related U.S. Application Data

(63) Continuation-in-part of application No. 09/794,671, filed on Feb. 27, 2001, now Pat. No. 6,471,327.

(51) Int. Cl.[7] ..... B41J 2/015

(52) U.S. Cl. ..... 347/21

(58) Field of Search ..... 347/95, 97, 21, 347/85, 86, 87; 250/288, 251

(56) References Cited

U.S. PATENT DOCUMENTS

| | | | | |
|---|---|---|---|---|
| 4,734,227 | A | | 3/1988 | Smith |
| 5,020,774 | A | | 6/1991 | Christianson |
| 5,178,325 | A | | 1/1993 | Nielsen |
| 5,270,542 | A | | 12/1993 | McMurry et al. |
| 5,565,677 | A | | 10/1996 | Wexler et al. |
| 6,116,718 | A | | 9/2000 | Peeters et al. |
| 6,471,327 | B2 | * | 10/2002 | Jagannathan et al. ..... 347/21 |

* cited by examiner

*Primary Examiner*—Anh T. N. Vo
(74) *Attorney, Agent, or Firm*—William R. Zimmerli

(57) ABSTRACT

An apparatus and method of delivering a functional material is provided. The apparatus includes a pressurized source of fluid in a thermodynamically stable mixture with a functional material. A discharge device having an inlet and an outlet is connected to the pressurized source at the inlet. The discharge device is shaped to produce a collimated beam of functional material, where the fluid is in a gaseous state at a location before or beyond the outlet of the discharge device. A beam control device is positioned proximate to the outlet of the discharge device such that the collimated beam of functional material is controlled after the collimated beam of functional material moves through the outlet of the discharge device.

11 Claims, 19 Drawing Sheets

APPARATUS AND METHOD OF DELIVERING A BEAM OF A FUNCTIONAL MATERIAL TO A RECEIVER

CROSS REFERENCE TO RELATED APPLICATIONS

This is a continuation-in-part of application Ser. No. 09/794,671, filed Feb. 27, 2001 now U.S. Pat. No. 6,471,327, entitled "Apparatus and Method of Delivering A Focused Beam of A Thermodynamically Stable/Metastable Mixture of A Functional Material In A Dense Fluid Onto A Receiver" in the name of Ramesh Jagannathan et al.

FIELD OF THE INVENTION

This invention relates generally to deposition and etching technologies and, more particularly, to a technology for delivering a collimated and/or focused beam of functional materials dispersed and/or dissolved in a compressible fluid that is in a supercritical or liquid state and becomes a gas at ambient conditions, to create a high-resolution pattern or image onto a receiver.

BACKGROUND OF THE INVENTION

Several conventional high-resolution deposition and etching technologies are used in the creation of value-added multi-layer products in applications ranging from semiconductor processing to imaging media manufacture. In this sense, deposition technologies are typically defined as technologies that deposit functional materials dissolved and/or dispersed in a fluid onto a receiver (also commonly referred to as a substrate, etc.) to create a pattern. Etching technologies are typically defined as technologies that create a specific pattern on a receiver through the selective alteration of portions of the receiver by delivering materials dissolved and/or dispersed in a fluid onto the receiver to physically remove selective portions of the receiver and/or chemically modify the receiver.

Technologies that deposit a functional material onto a receiver using gaseous propellants are known. For example, Peeters et al., in U.S. Pat. No. 6,116,718, issued Sep. 12, 2000, disclose a print head for use in a marking apparatus in which a propellant gas is passed through a channel, the functional material is introduced controllably into the propellant stream to form a ballistic aerosol for propelling non-colloidal, solid or semi-solid particulate or a liquid, toward a receiver with sufficient kinetic energy to fuse the marking material to the receiver. There is a problem with this technology in that the functional material and propellant stream are two different entities and the propellant is used to impart kinetic energy to the functional material. When the functional material is added into the propellant stream in the channel, a non-colloidal ballistic aerosol is formed prior to exiting the print head. This non-colloidal ballistic aerosol, which is a combination of the functional material and the propellant, is not thermodynamically stable/metastable. As such, the functional material is prone to settling in the propellant stream which, in turn, can cause functional material agglomeration leading to nozzle obstruction and poor control over functional material deposition.

Technologies that use supercritical fluid solvents to create thin films are also known. For example, R. D. Smith in U.S. Pat. No. 4,734,227, issued Mar. 29, 1988, discloses a method of depositing solid films or creating fine powders through the dissolution of a solid material into a supercritical fluid solution and then rapidly expanding the solution to create particles of the functional material in the form of fine powders or long thin fibers which may be used to make films. There is a problem with this method in that the free-jet expansion of the supercritical fluid solution results in a non-collimated/defocused spray that can not be used to create high resolution patterns on a receiver. Further, defocusing leads to losses of the functional material.

As such, there is a need for a technology that permits high speed, accurate, and precise deposition of a functional material on a receiver. There is also a need for a technology that permits functional material deposition of ultra-small (nano-scale) particles. There is also a need for a technology that permits high speed, accurate, and precise etching of a receiver that permits the creation of ultra-small (nano-scale) features on a receiver. Additionally, there is a need for a self-energized, self-cleaning technology capable of controlled solute deposition in a format that is free from receiver size restrictions. There is also a need for a technology that permits high speed, accurate, and precise patterning of a receiver that can be used to create a high resolution patterns on a receiver. There is also a need for a technology that permits high speed, accurate, and precise patterning of a receiver having reduced material agglomeration characteristics. There is also a need for a technology that permits high speed, accurate, and precise patterning of a receiver wherein the functional material to be deposited on the receiver and dense fluid which is the carrier of the functional material, are in a thermodynamically stable/metastable mixture. There is also a need for a technology that permits high speed, accurate, and precise patterning of a receiver that has improved material deposition capabilities.

SUMMARY OF THE INVENTION

An object of the present invention is to provide a technology that permits high speed, accurate, and precise deposition of a functional material on a receiver.

Another object of the present invention is to provide a technology that permits functional material deposition of ultra-small particles.

Another object of the present invention is to provide a technology that permits high speed, accurate, and precise patterning of a receiver that permits the creation of ultra-small features on the receiver.

Another object of the present invention is to provide a self-energized, self-cleaning technology capable of controlled functional material deposition in a format that is free from receiver size restrictions.

Another object of the present invention is to provide a technology that permits high speed, accurate, and precise patterning of a receiver that can be used to create high resolution patterns on the receiver.

Yet another object of the present invention is to provide a technology that permits high speed, accurate, and precise patterning of a receiver having reduced functional material agglomeration characteristics.

Yet another object of the present invention is to provide a technology that permits high speed, accurate, and precise patterning of a receiver using a mixture of functional material and dense fluid that is thermodynamically stable/metastable.

Yet another object of the present invention is to provide a technology that permits high speed, accurate, and precise patterning of a receiver that has improved material deposition capabilities.

According to a feature of the present invention, an apparatus for delivering a functional material includes a pressurized source of a thermodynamically stable mixture of a fluid and a functional material. A discharge device, having an inlet and an outlet, is connected to the pressurized source at the inlet. The discharge device is shaped to produce a collimated beam of functional material. The fluid is in a gaseous state at a location beyond the outlet of the discharge device. The fluid can be a compressed liquid having a density equal to or greater than 0.1 grams per cubic centimeter; a supercritical fluid having a density equal to or greater than 0.1 grams per cubic centimeter; or a compressed gas having a density equal to or greater than 0.1 grams per cubic centimeter. A beam control device can be positioned proximate to the outlet of the discharge device such that the collimated beam of functional material is controlled after the collimated beam of functional material moves through the outlet of the discharge device.

According to another feature of the invention, a method of delivering a functional material includes providing a pressurized source of a thermodynamically stable mixture of a fluid and a functional material; and causing the functional material to collimate by passing the thermodynamically stable mixture of the fluid and the functional material through a discharge device. The functional material can be focused by passing the functional material through a beam control device.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art. Additionally, materials identified as suitable for various facets of the invention, for example, functional materials, solvents, equipment, etc. are to be treated as exemplary, and are not intended to limit the scope of the invention in any manner.

Figure 1A:
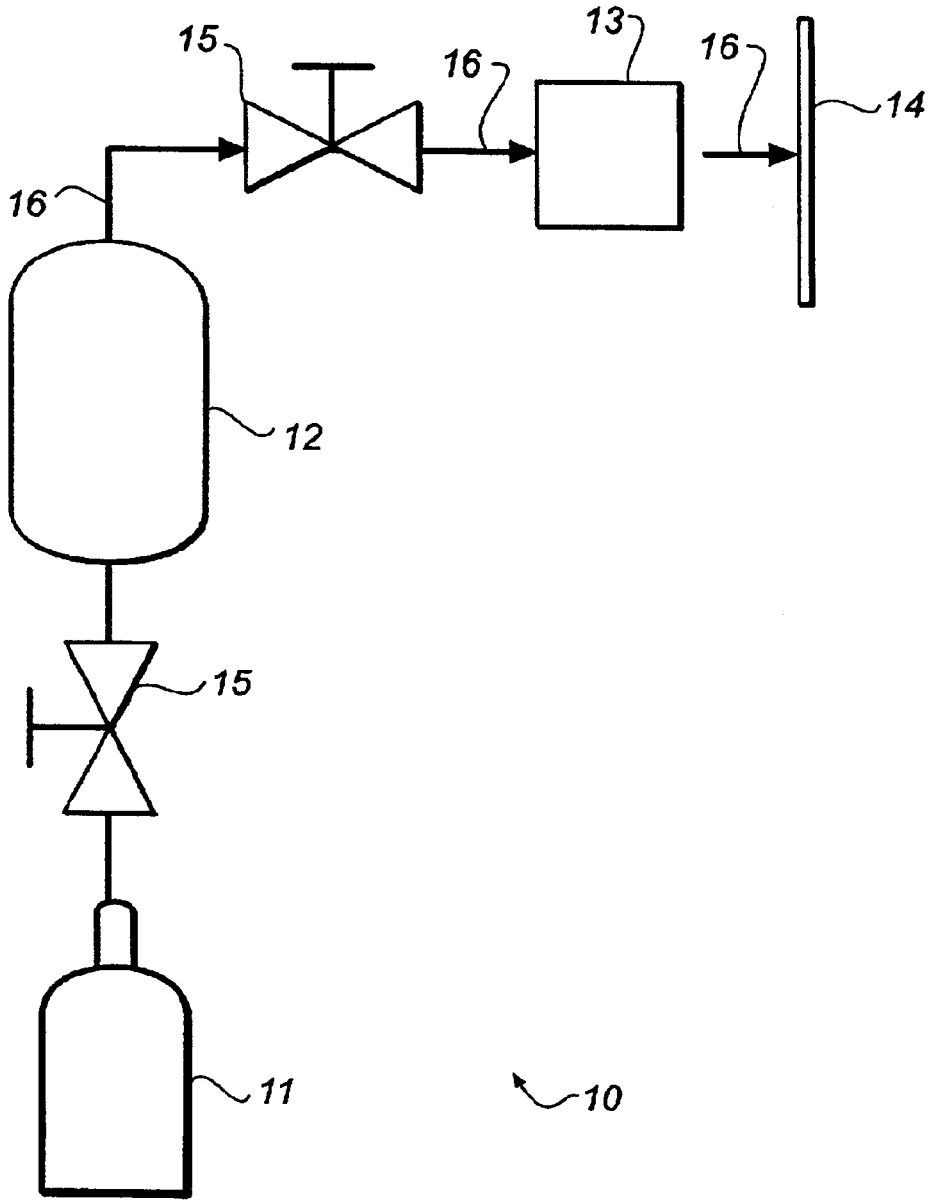
FIG. 1A is a schematic view of a preferred embodiment made in accordance with the present invention.

Referring to FIG. 1A, delivery system 10 has components, 11, 12, and 13 that take chosen solvent and/or dispersant materials (fluids) to a compressed liquid, compressed gas and/or supercritical fluid state, make a solution and/or dispersion of an appropriate functional material or combination of functional materials in the chosen compressed liquid, compressed gas, and/or supercritical fluid, and deliver the functional materials as a collimated and/or focused beam onto a receiver 14 in a controlled manner. Functional materials can be any material that needs to be delivered to a receiver, for example electroluminescent materials, imaging dyes, ceramic nanoparticles etc., to create a pattern on the receiver by deposition, etching, coating, other processes involving the placement of a functional material on a receiver, etc.

In this context, the chosen materials (fluids) taken to a compressed gas, compressed liquid and/or supercritical fluid state are gases at ambient pressure and temperature. These fluids have a density that is greater than or equal to 0.1 grams per cubic centimeter. Such fluids are able to dissolve, and hold in solution, functional solute materials of interest. Additionally, these fluids are able to hold functional solute materials of interest in a dispersion. Ambient conditions are preferably defined as temperature in the range from −100 to +100° C., and pressure in the range from $1\times10^{-8}$–100 atm for this application.

In FIG. 1A a schematic illustration of the delivery system 10 is shown. The delivery system 10 has a compressed liquid/compressed gas/supercritical fluid source 11, a formulation reservoir 12, and a discharge device 13 connected in fluid communication along a delivery path 16. The delivery system 10 can also include a valve or valves 15 positioned along the delivery path 16 in order to control flow of the compressed liquid/compressed gas/supercritical fluid.

A compressed liquid/compressed gas/supercritical fluid carrier, contained in the compressed liquid/compressed gas/supercritical fluid source 11, is any material that dissolves/solubilizes/disperses a functional material. The fluid source 11 delivers the compressed liquid/compressed gas/supercritical fluid carrier at predetermined conditions of pressure, temperature, and flow rate as a supercritical fluid, a compressed gas, or a compressed liquid. Materials in their supercritical fluid/compressed gas/compressed liquid state that exist as gases at ambient conditions find application here because of their unique ability to solubilize and/or disperse functional materials of interest in the compressed liquid, compressed gas, or supercritical state.

Materials that are above their critical point, defined by a critical temperature and a critical pressure, are known as supercritical fluids. The critical temperature and critical pressure typically define a thermodynamic state in which a fluid or a material becomes supercritical and exhibits gas like and liquid like properties.

Materials that are at sufficiently high critical temperatures and pressures below their critical point are known as compressed liquids. Materials that are at sufficiently high critical pressures and temperatures below their critical point are known as compressed gasses.

Fluid carriers include, but are not limited to, carbon dioxide, nitrous oxide, ammonia, xenon, ethane, ethylene, propane, propylene, butane, isobutane, chlorotrifluoromethane, monofluoromethane, sulphur hexafluoride and mixtures thereof. Due its characteristics, e.g. low cost, wide availability, etc., carbon dioxide is generally preferred in many applications.

The formulation reservoir 12 is utilized to dissolve and/or disperse functional materials in compressed liquids, compressed gasses, or supercritical fluids with or without dispersants and/or surfactants, at desired formulation conditions of temperature, pressure, volume, and concentration. The combination of functional material and compressed liquid/compressed gas/supercritical fluid is typically referred to as a mixture, formulation, etc.

The formulation reservoir 12 can be made out of any suitable materials that can safely operate at the formulation conditions. An operating range from 0.001 atmosphere ($1.013\times10^2$ Pa) to 1000 atmospheres ($1.013\times10^8$ Pa) in pressure and from −25 degrees Centigrade to 1000 degrees Centigrade is generally preferred. Typically, the preferred materials include various grades of high pressure stainless steel. However, it is possible to use other materials if the specific deposition or etching application dictates less extreme conditions of temperature and/or pressure.

The formulation reservoir 12 should be precisely controlled with respect to the operating conditions (pressure, temperature, and volume). The solubility/dispersibility of functional materials depends upon the conditions within the formulation reservoir 12. As such, small changes in the operating conditions within the formulation reservoir 12 can have undesired effects on functional material solubility/dispensability.

Additionally, any suitable surfactant and/or dispersant material that is capable of solubilizing/dispersing the functional materials in the compressed liquid/compressed gas/supercritical fluid for a specific application can be incorporated into the mixture of functional material and compressed liquid/compressed gas/supercritical fluid. Such materials include, but are not limited to, fluorinated polymers such as perfluoropolyether, siloxane compounds, etc.

Figure 1B:
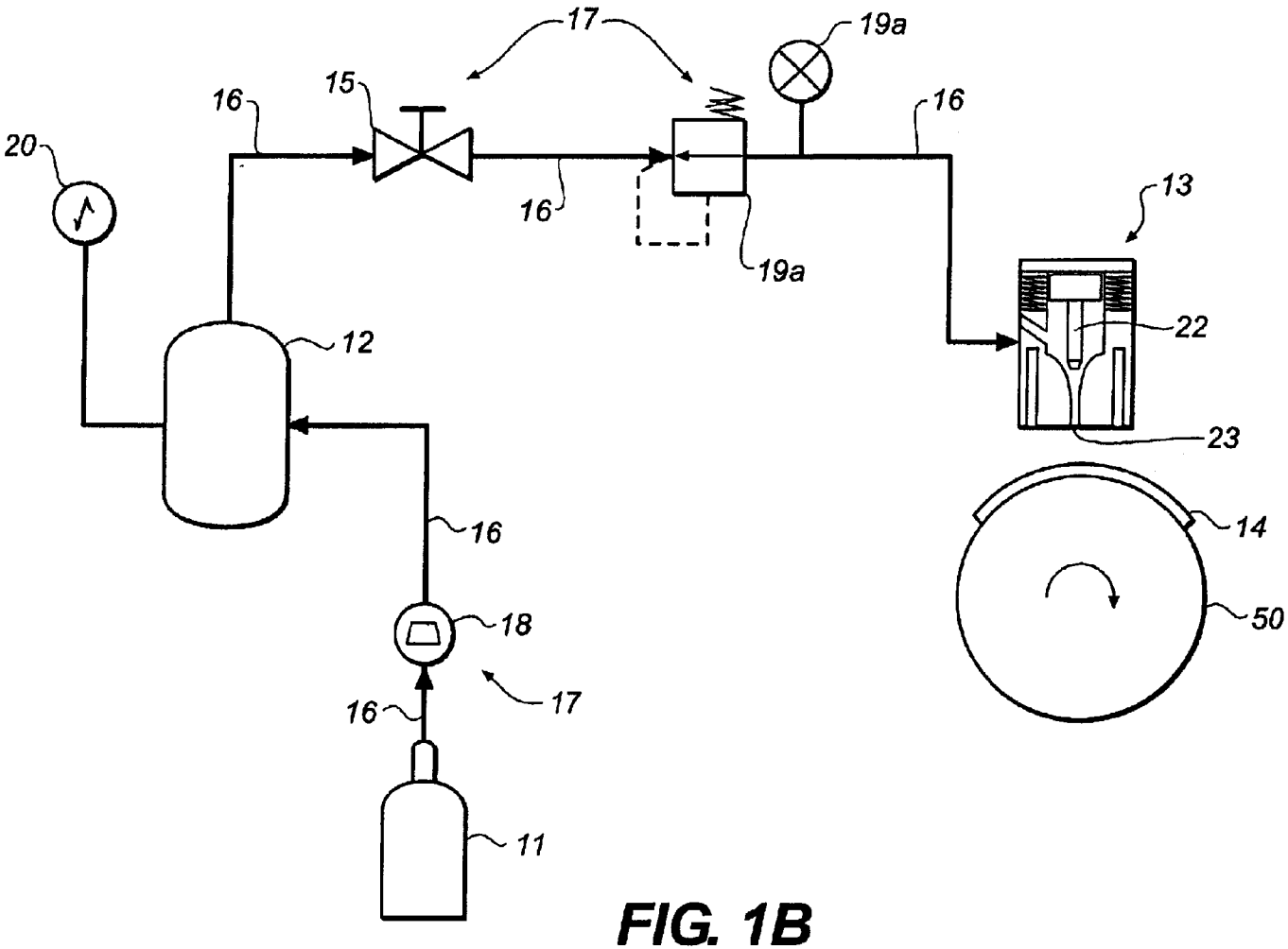
FIGS. 1B–1G are schematic views of alternative embodiments made in accordance with the present invention.
Figure 1C:
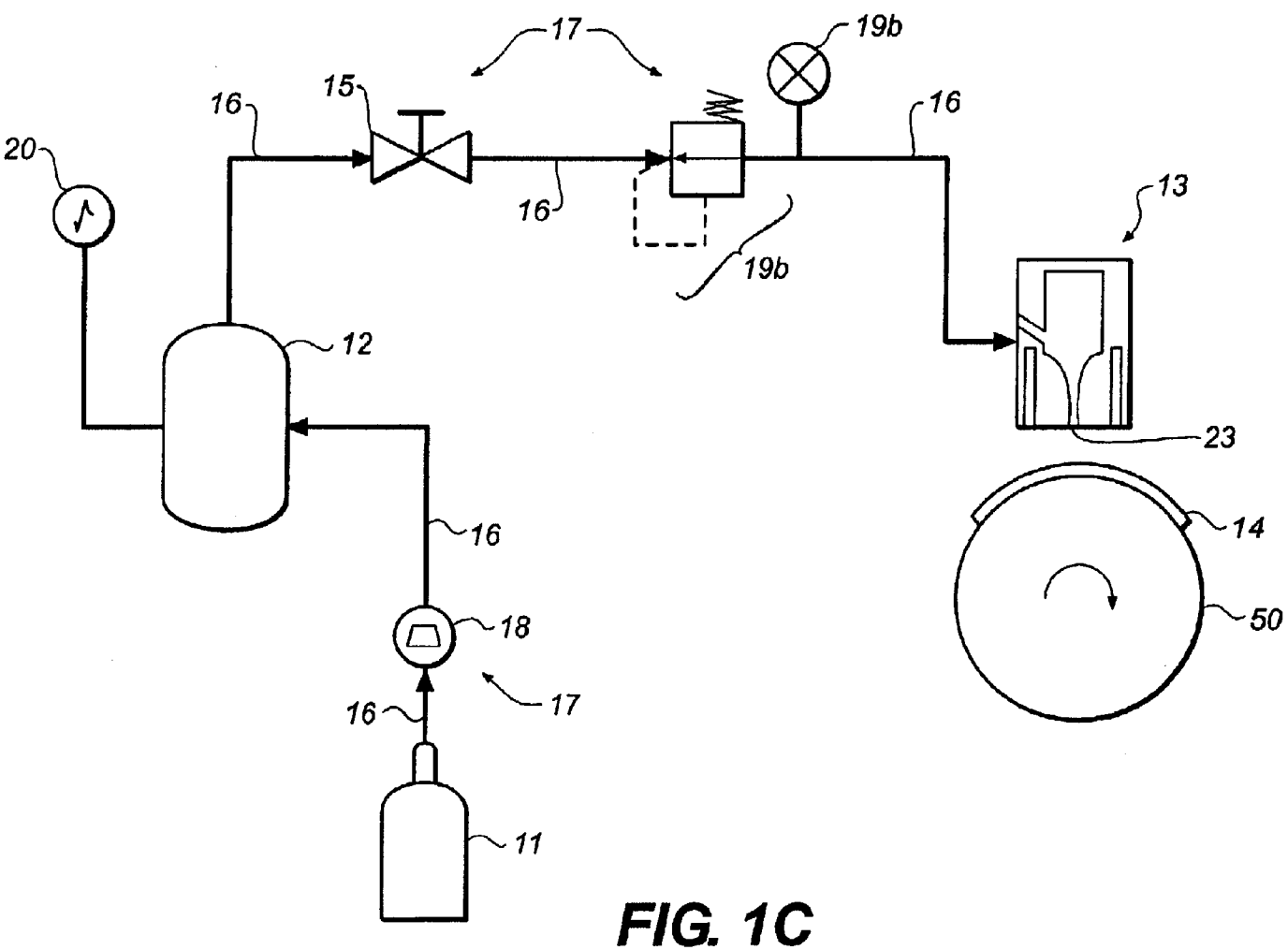
Figure 1D:
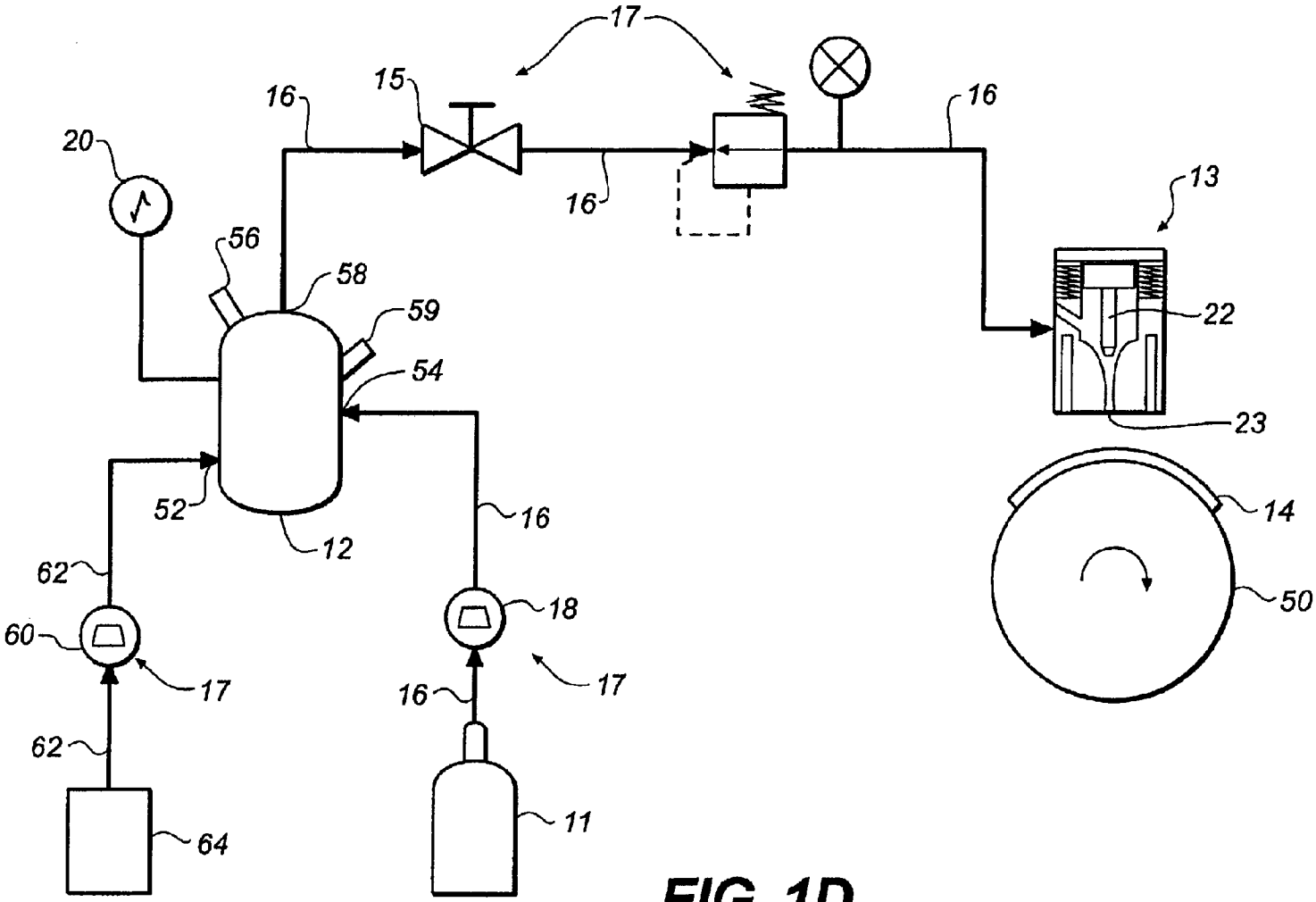

Referring to FIGS. 1B–1D, alternative embodiments of the invention shown in FIG. 1A are described. In each of these embodiments, individual components are in fluid communication, as is appropriate, along the delivery path 16.

Referring to FIGS. 1B and 1C, a pressure control mechanism 17 is positioned along the delivery path 16. The pressure control mechanism 17 is used to create and maintain a desired pressure required for a particular application. The pressure control mechanism 17 can include a pump 18, a valve(s) 15, and a pressure regulator 19*a*, as shown in FIG. 1B. Alternatively, the pressure control mechanism 17 can include a pump 18, a valve(s) 15, and a multi-stage pressure regulator 19*b*, as shown in FIG. 1C. Additionally, the pressure control mechanism can include alternative combinations of pressure controlling devices, etc. For example, the pressure control mechanism 17 can include additional valve (s) 15, actuators to regulate fluid/formulation flow, variable volume devices to change system operating pressure, etc., appropriately positioned along the delivery path 16. Typically, the pump 18 is positioned along the delivery path 16 between the fluid source 11 and the formulation reservoir 12. The pump 18 can be a high pressure pump that increases and maintains system operating pressure, etc. The pressure control mechanism 17 can also include any number of monitoring devices, gauges, etc., for monitoring the pressure of the delivery system 10.

A temperature control mechanism 20 is positioned along delivery path 16 in order to create and maintain a desired temperature for a particular application. The temperature control mechanism 20 is preferably positioned at the formulation reservoir 12. The temperature control mechanism 20 can include a heater, a heater including electrical wires, a water jacket, a refrigeration coil, a combination of temperature controlling devices, etc. The temperature control mechanism can also include any number of monitoring devices, gauges, etc., for monitoring the temperature of the delivery system 10.

The discharge device 13 includes a nozzle 23 positioned to provide directed delivery of the formulation towards the receiver 14. The discharge device 13 can also include a shutter 22 to regulate the flow of the supercritical fluid/compressed liquid/compressed gas and functional material mixture or formulation. The shutter 22 regulates flow of the formulation in a predetermined manner (i.e. on/off or partial opening operation at desired frequency, etc.). The shutter 22 can be manually, mechanically, pneumatically, electrically or electronically actuated. Alternatively, the discharge device 13 does not have to include the shutter 22 (shown in FIG. 1C). As the mixture is under higher pressure, as compared to ambient conditions, in the delivery system 10, the mixture will naturally move toward the region of lower pressure, the area of ambient conditions. In this sense, the delivery system is said to be self-energized.

The receiver 14 can be positioned on a media conveyance mechanism 50 that is used to control the movement of the receiver during the operation of the delivery system 10. The media conveyance mechanism 50 can be a drum, an x, y, z translator, any other known media conveyance mechanism, etc.

Figure 1E:
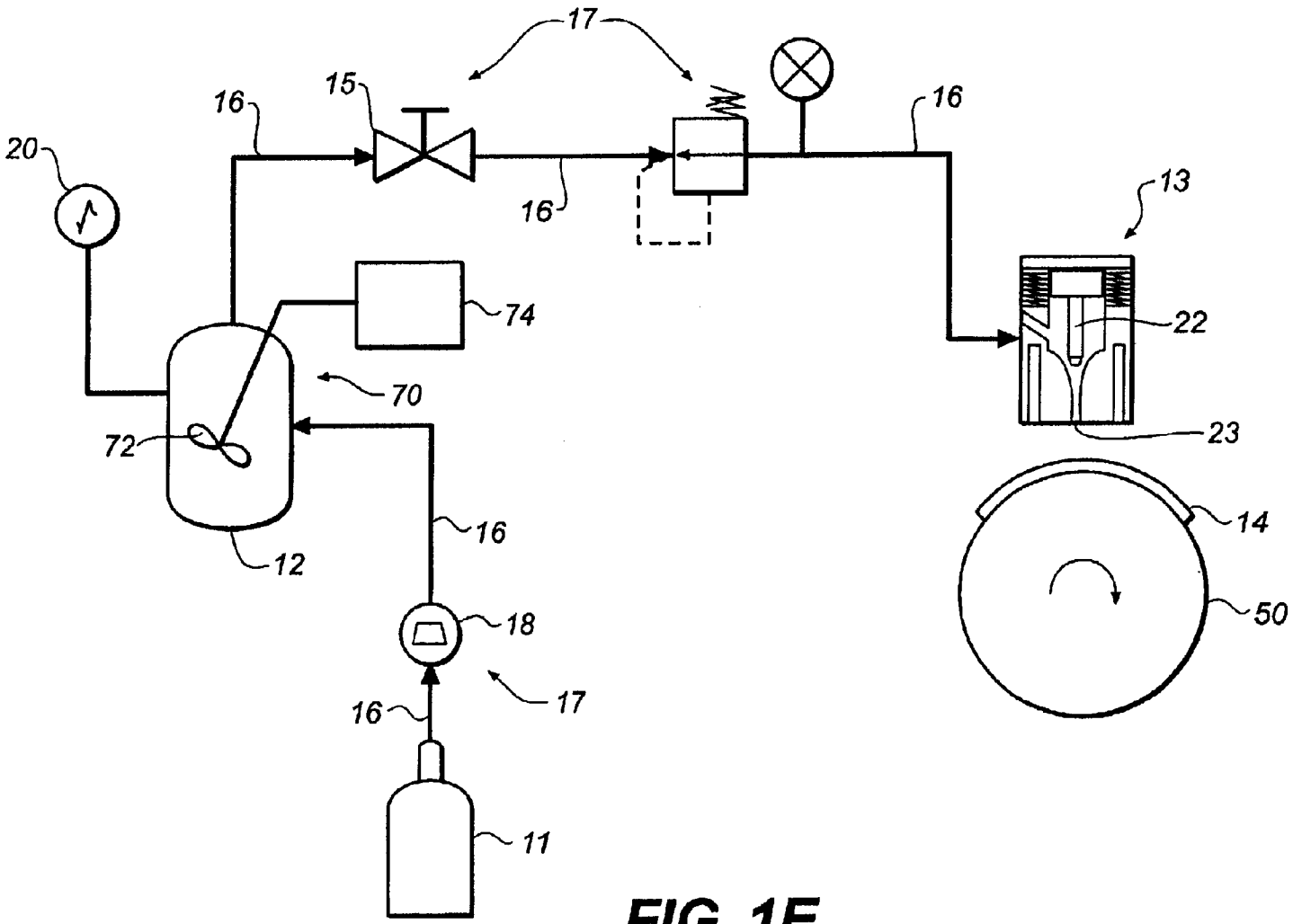

Referring to FIGS. 1D and 1E, the formulation reservoir 12 can be a pressurized vessel having appropriate inlet ports 52, 54, 56 and outlet ports 58. Inlet ports 52, 54, 56 can be used as an inlet for functional material 52 and an inlet for compressed liquid, compressed gas, or supercritical fluid 54. Alternatively, inlet port 56 can be used to manually add functional material to the formulation reservoir 12. Outlet port 58 can be used as an outlet for the mixture of functional material and compressed liquid/compressed gas/supercritical fluid.

When automated delivery of the functional material is desired, a pump 60 is positioned along a functional material delivery path 62 between a source of functional material 64 and the formulation reservoir 12. The pump 60 pumps a desired amount of functional material through inlet port 52 into the formulation reservoir 12. The formulation reservoir 12 can also include additional inlet/outlet ports 59 for inserting or removing small quantities of functional material or functional material and compressed liquid/compressed gas/supercritical fluid mixtures.

Referring to FIGS. 1D and 1E, the formulation reservoir 12 can include a mixing device 70 used to create the mixture of functional material and compressed liquid/compressed gas/supercritical fluid. Although typical, a mixing device 70 is not always necessary to make the mixture of the functional material and compressed liquid/compressed gas/supercritical fluid depending on the type of functional material and the type of compressed liquid/compressed gas/supercritical fluid. The mixing device 70 can include a mixing element 72 connected to a power/control source 74 to ensure that the functional material disperses into or forms a solution with the compressed liquid, compressed gas, or supercritical fluid. The mixing element 72 can be an acoustic, a mechanical, and/or an electromagnetic element.

Referring to FIGS. 1D, 1E, and FIGS. 4A–4J, the formulation reservoir 12 can also include suitable temperature control mechanisms 20 and pressure control mechanisms 17 with adequate gauging instruments to detect and monitor the temperature and pressure conditions within the reservoir, as described above. For example, the formulation reservoir 12 can include a moveable piston device 76, etc., to control and maintain pressure. The formulation reservoir 12 can also be equipped to provide accurate control over temperature within the reservoir. For example, the formulation reservoir 12 can include electrical heating/cooling zones 78, using electrical wires 80, electrical tapes, waterjackets 82, other heating/cooling fluid jackets, refrigeration coils 84, etc., to control and maintain temperature. The temperature control mechanisms 20 can be positioned within the formulation reservoir 12 or positioned outside the formulation reservoir. Additionally, the temperature control mechanisms 20 can be positioned over a portion of the formulation reservoir 12, throughout the formulation reservoir 12, or over the entire area of the formulation reservoir 12.

Figure 4A:
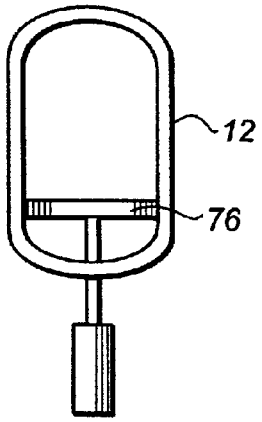
FIGS. 4A–4K are cross sectional views of a portion of the invention shown in FIG. 1A.
Figure 4B:
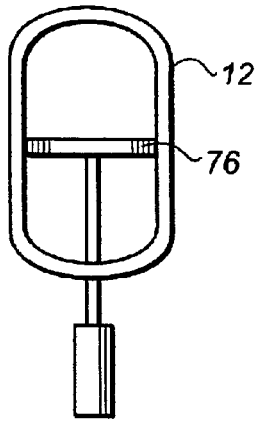
Figure 4C:
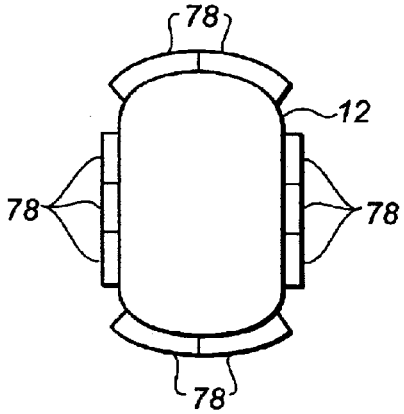
Figure 4D:
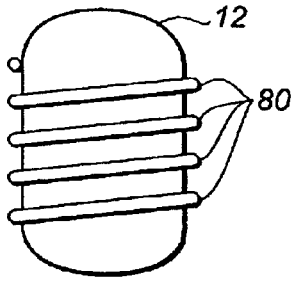
Figure 4E:
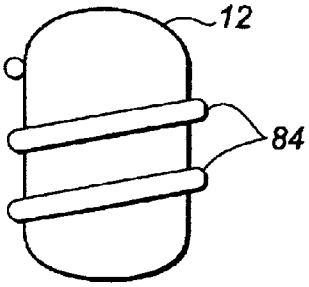
Figure 4F:
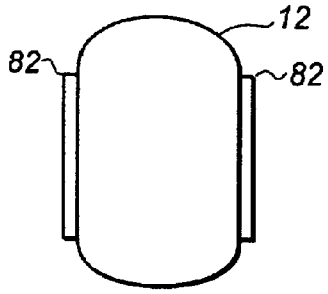
Figure 4G:
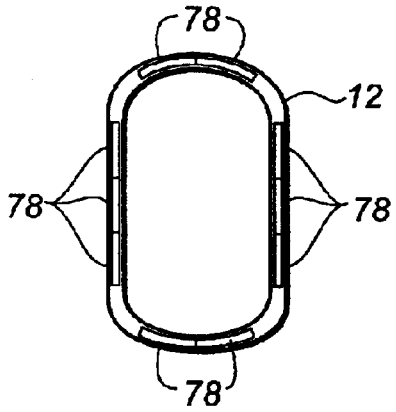
Figure 4H:
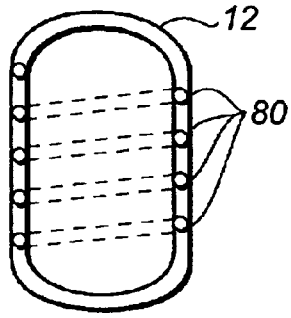
Figure 4I:
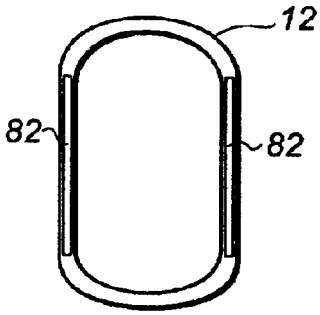
Figure 4J:
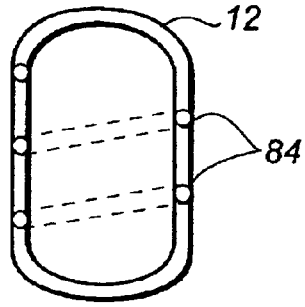
Figure 4K:
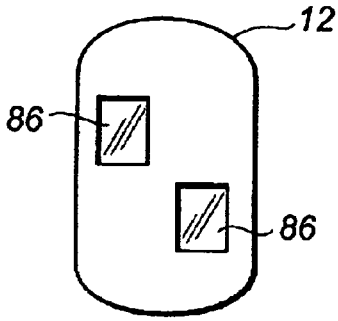

Referring to FIG. 4K, the formulation reservoir 12 can also include any number of suitable high-pressure windows 86 for manual viewing or digital viewing using an appropriate fiber optics or camera set-up. The windows 86 are typically made of sapphire or quartz or other suitable materials that permit the passage of the appropriate frequencies of radiation for viewing/detection/analysis of reservoir contents (using visible, infrared, X-ray etc. viewing/detection/analysis techniques), etc.

The formulation reservoir 12 is made of appropriate materials of construction in order to withstand high pressures of the order of 10,000 psi or greater. Typically, stainless steel is the preferred material of construction although other high pressure metals, metal alloys, and/or metal composites can be used.

Figure 1F:
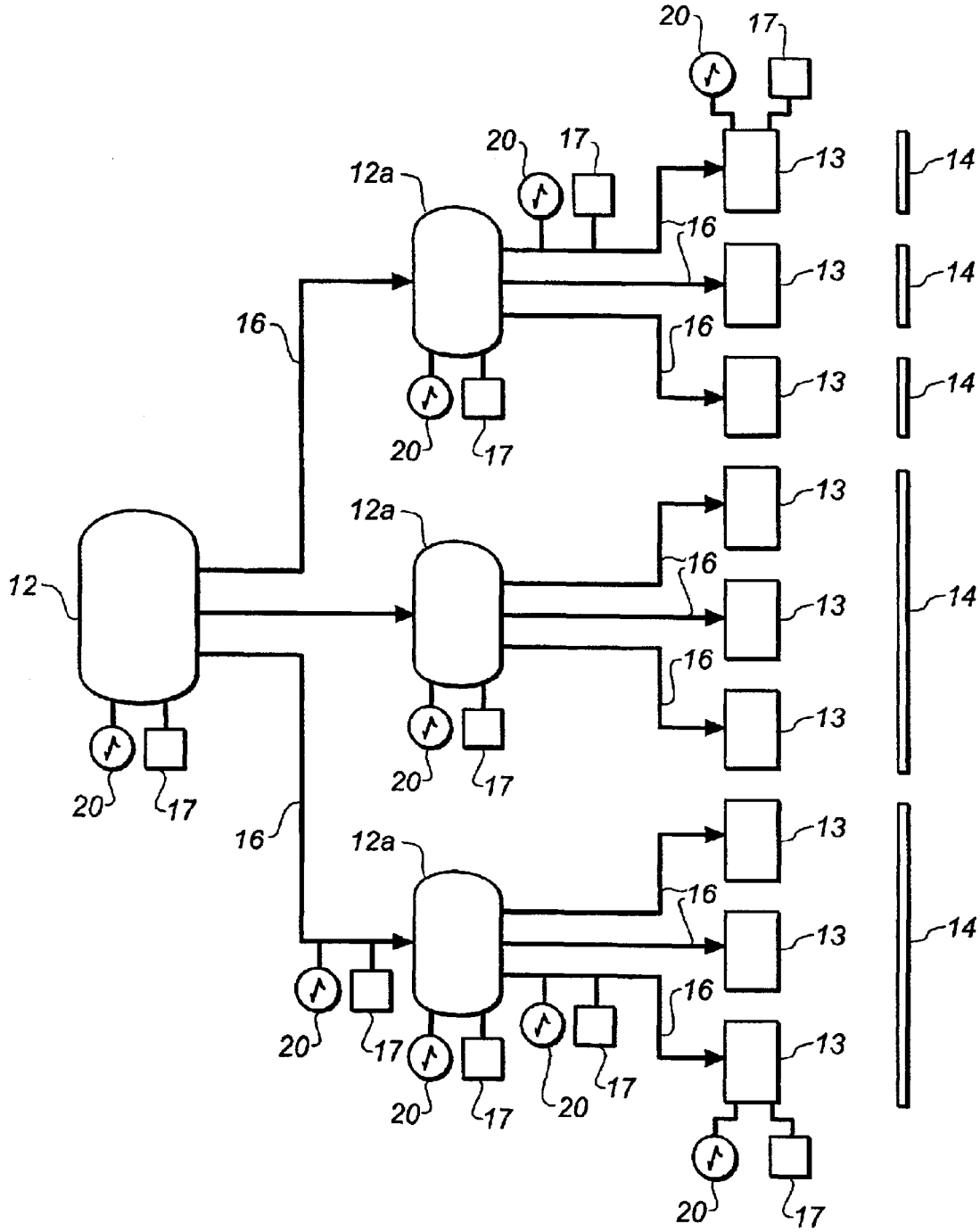

Referring to FIG. 1F, in an alternative arrangement, the thermodynamically stable/metastable mixture of functional material and compressed liquid/compressed gas/supercritical fluid can be prepared in one formulation reservoir 12 and then transported to one or more additional formulation reservoirs 12*a*. For example, a single large formulation reservoir 12 can be suitably connected to one or more subsidiary high pressure vessels 12*a* that maintain the functional material and compressed liquid/compressed gas/supercritical fluid mixture at controlled temperature and pressure conditions with each subsidiary high pressure vessel 12*a* feeding one or more discharge devices 13. Either or both reservoirs 12 and 12*a* can be equipped with the temperature control mechanism 20 and/or pressure control mechanisms 17. The discharge devices 13 can direct the mixture towards a single receiver 14 or a plurality of receivers 14.

Figure 1G:
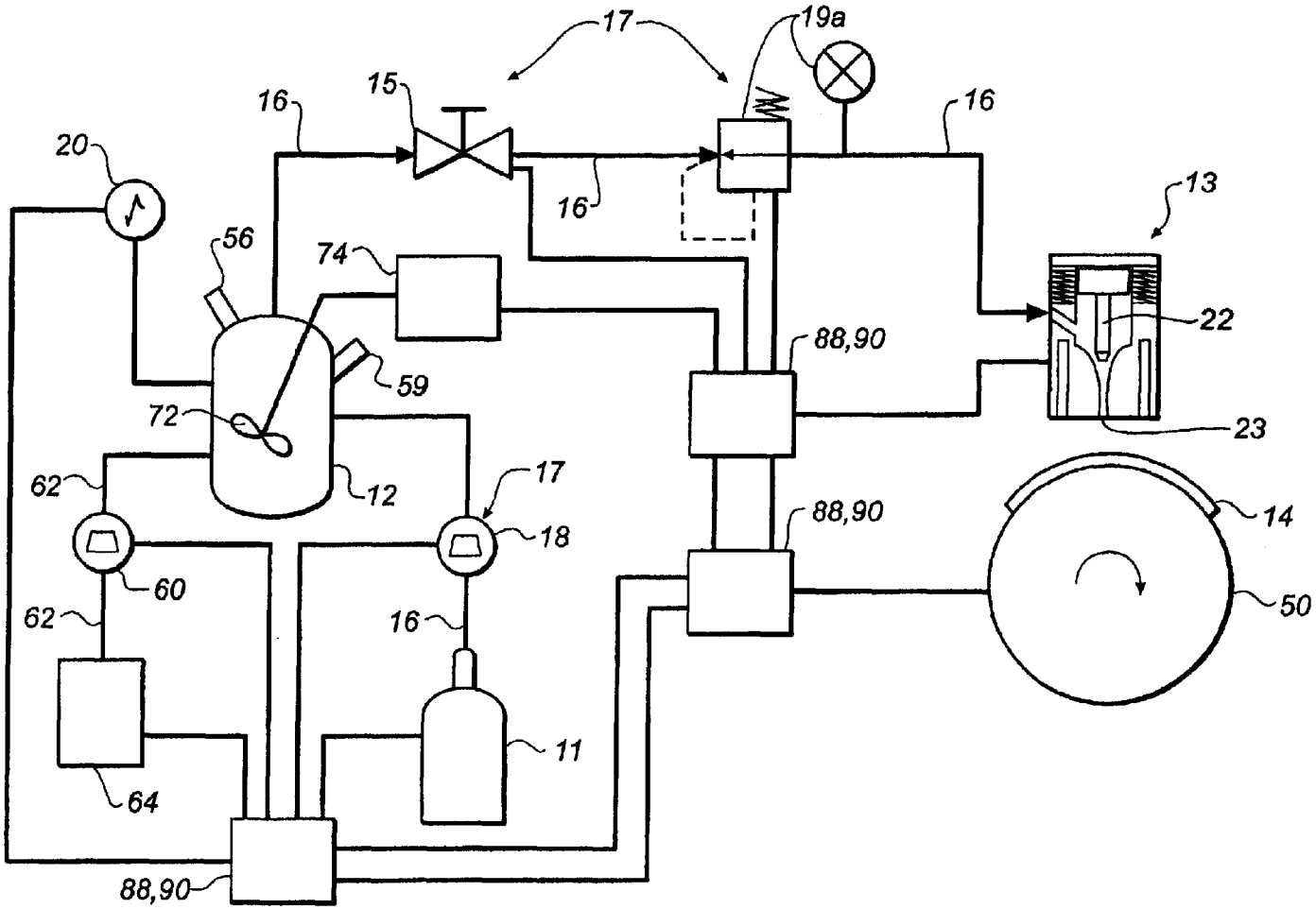

Referring to FIG. 1G, the delivery system 10 can include ports for the injection of suitable functional material, view cells, and suitable analytical equipment such as Fourier Transform Infrared Spectroscopy, Light Scattering, Ultra-Violet or Visible Spectroscopy, etc. to permit monitoring of the delivery system 13 and the components of the delivery system. Additionally, the delivery system 10 can include any number of control devices 88, microprocessors 90, etc., used to control the delivery system 10.

Figure 2A:
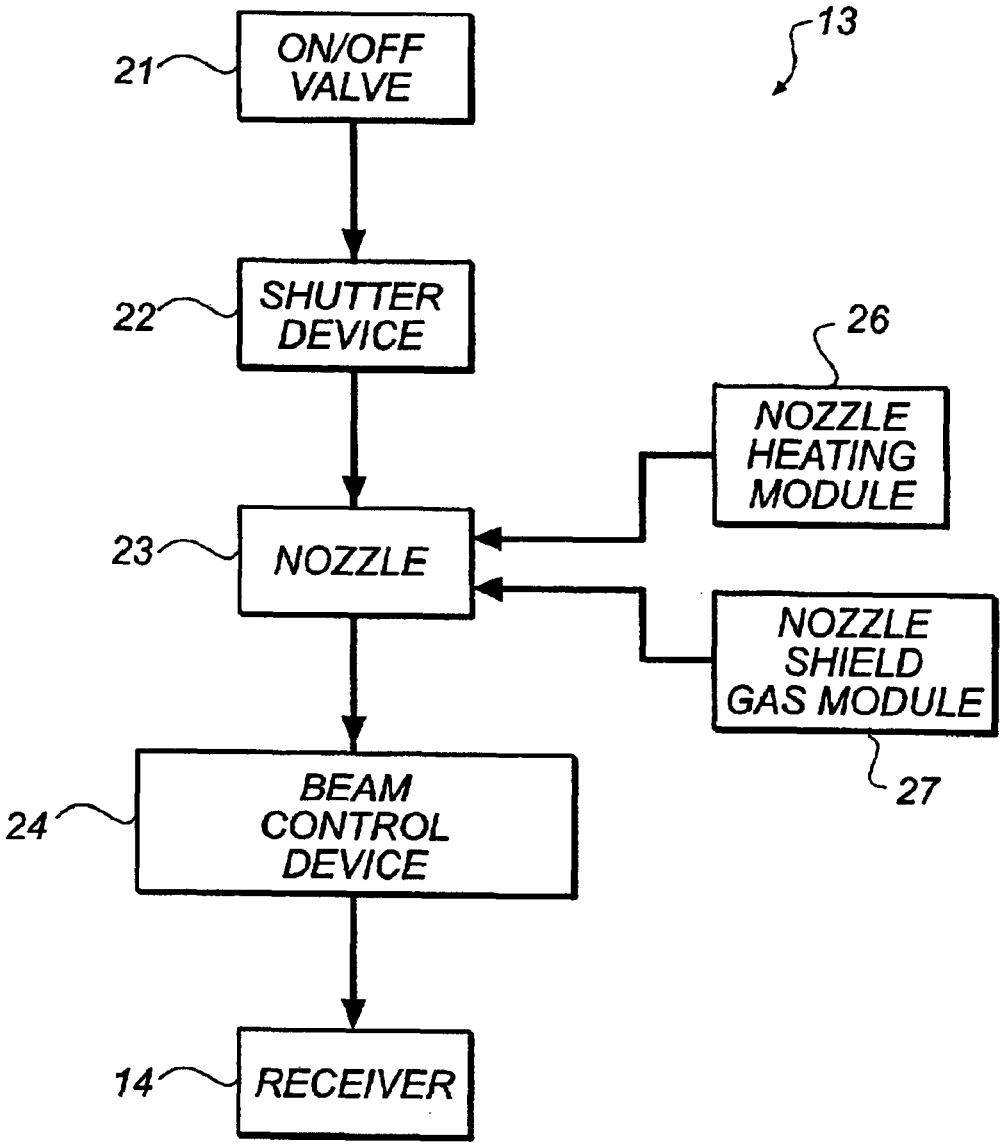
FIG. 2A is a block diagram of a discharge device made in accordance with the present invention.
Figure 2B:
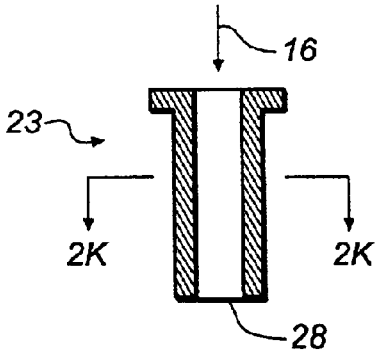
FIGS. 2B–2M are cross sectional views of a nozzle portion of the device shown in FIG. 2A.
Figure 2K:
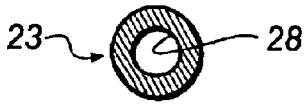
Figure 2C:
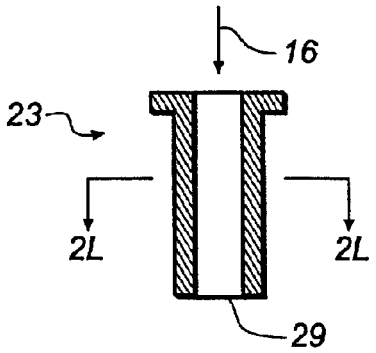
Figure 2L:
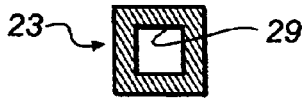
Figure 2D:
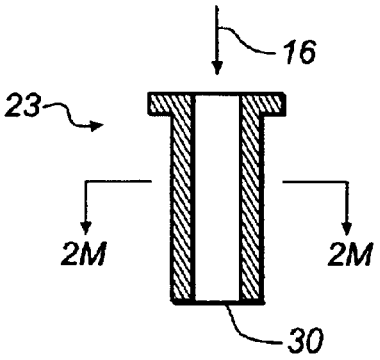
Figure 2M:
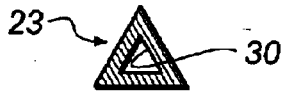
Figure 2E:
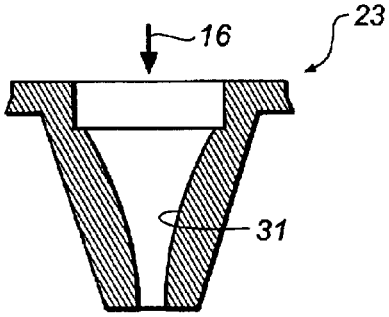
Figure 2F:
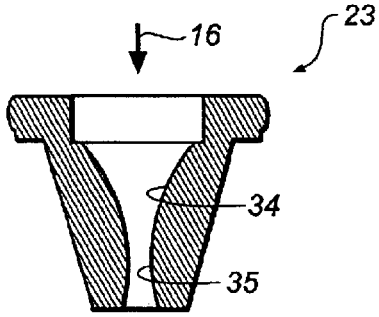

Referring to FIG. 2A, the discharge device 13 is described in more detail. The discharge assembly can include an on/off valve 21 that can be manually or automatically actuated to regulate the flow of the supercritical fluid, compressed gas, or compressed liquid formulation. The discharge device 13 includes a shutter device 22 which can also be a programmable valve. The shutter device 22 is capable of being controlled to turn off the flow and/or turn on the flow so that the flow of formulation occupies all or part of the available cross-section of the discharge device 13. Additionally, the shutter device is capable of being partially opened or closed in order to adjust or regulate the flow of formulation. The discharge assembly also includes a nozzle 23. The nozzle 23 can be provided, as necessary, with a nozzle heating module 26 and a nozzle shield gas module 27 to assist in beam collimation. The discharge device 13 also includes a beam control device 24 to assist in beam collimation prior to the beam reaching a receiver 25. Components 22–24, 26, and 27 of discharge device 13 are positioned relative to delivery path 16 such that the formulation continues along delivery path 16.

Alternatively, the shutter device 22 can be positioned after the nozzle heating module 26 and the nozzle shield gas module 27 or between the nozzle heating module 26 and the nozzle shield gas module 27. Additionally, the nozzle shield gas module 27 may not be required for certain applications, as is the case with the beam control device 24. Alternatively, discharge device 13 can include a beam control device 24 and not include the shutter device 22. In this situation, the beam control device 24 can be moveably positioned along delivery path 16 and used to regulate the flow of formulation such that a continuous flow of formulation exits while still allowing for discontinuous deposition and/or etching.

The nozzle 23 can be capable of translation in x, y, and z directions to permit suitable discontinuous and/or continuous functional material deposition and/or etching on the receiver 14. Translation of the nozzle can be achieved through manual, mechanical, pneumatic, electrical, electronic or computerized control mechanisms. Receiver 14 and/or media conveyance mechanism 50 can also be capable of translation in x, y, and z directions to permit suitable functional material deposition and/or etching on the receiver 14. Alternatively, both the receiver 14 and the nozzle 23 can be translatable in x, y, and z directions depending on the particular application.

Referring to FIGS. 2B–2M, the nozzle 23 functions to direct the formulation flow towards the receiver 14. It is also used to attenuate the final velocity with which the functional material impinges on the receiver 14. Accordingly, nozzle geometry can vary depending on a particular application. For example, nozzle geometry can be a constant area having a predetermined shape (cylinder 28, square 29, triangular 30, etc.) or variable area converging 31, variable area diverging 38, or variable area converging-diverging 32, with various forms of each available through altering the angles of convergence and/or divergence. Alternatively, a combination of a constant area with a variable area, for example, a converging-diverging nozzle with a tubular extension, etc., can be used. In addition, the nozzle 23 can be coaxial, axisymmetric, asymmetric, or any combination thereof (shown generally in 33). The shape 28, 29, 30, 31, 32, 33 of the nozzle 23 can assist in regulating the flow of the formulation. In a preferred embodiment of the present invention, the nozzle 23 includes a converging section or module 34, a throat section or module 35, and a diverging section or module 36. The throat section or module 35 of the nozzle 23 can have a straight section or module 37.

The discharge device 13 serves to direct the functional material onto the receiver 14. The discharge device 13 or a portion of the discharge device 13 can be stationary or can swivel or raster, as needed, to provide high resolution and high precision deposition of the functional material onto the receiver 14 or etching of the receiver 14 by the functional material. Alternatively, receiver 14 can move in a predetermined way while discharge device 13 remains stationary. The shutter device 22 can also be positioned after the nozzle 23. As such, the shutter device 22 and the nozzle 23 can be separate devices so as to position the shutter 22 before or after the nozzle 23 with independent controls for maximum deposition and/or etching flexibility. Alternatively, the shutter device 22 can be integrally formed within the nozzle 23.

Figure 3B:
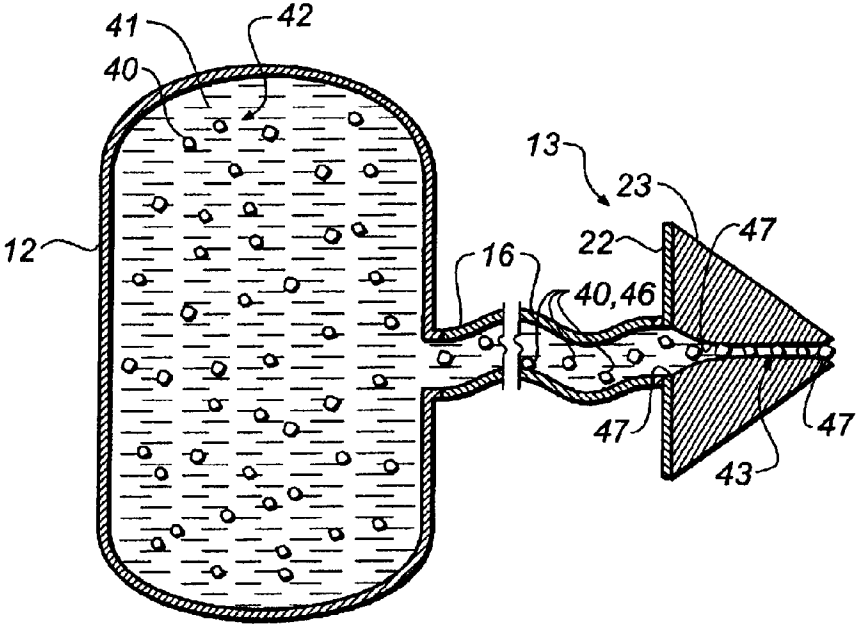
FIGS. 3A–3D are diagrams schematically representing the operation of the present invention.
Figure 3A:
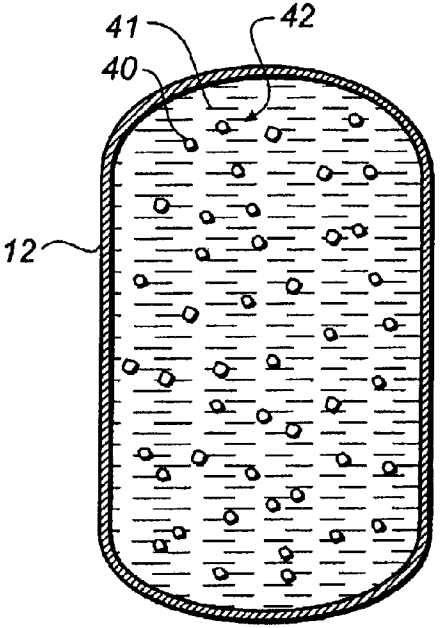
Figure 3C:
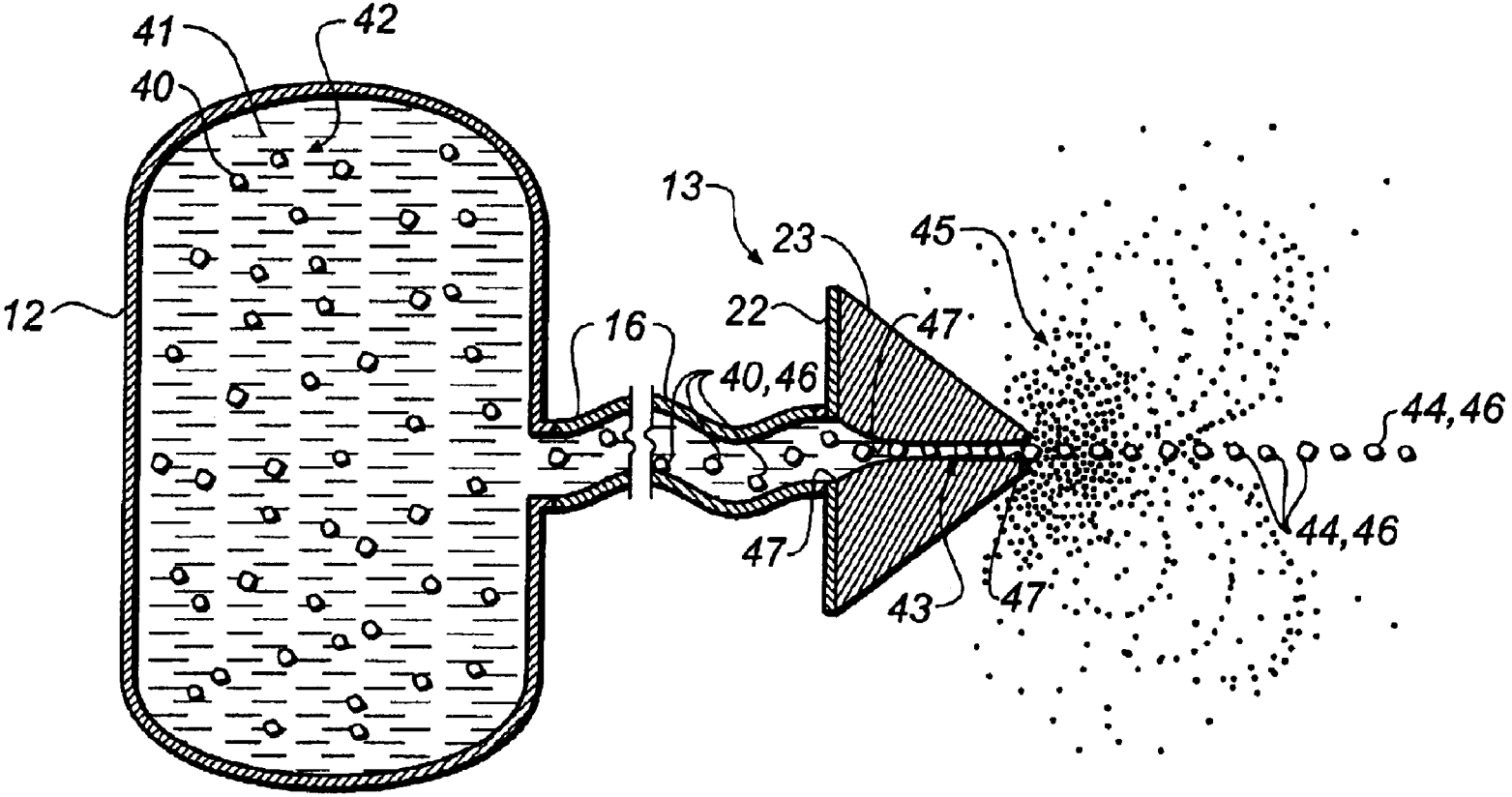
Figure 3D:
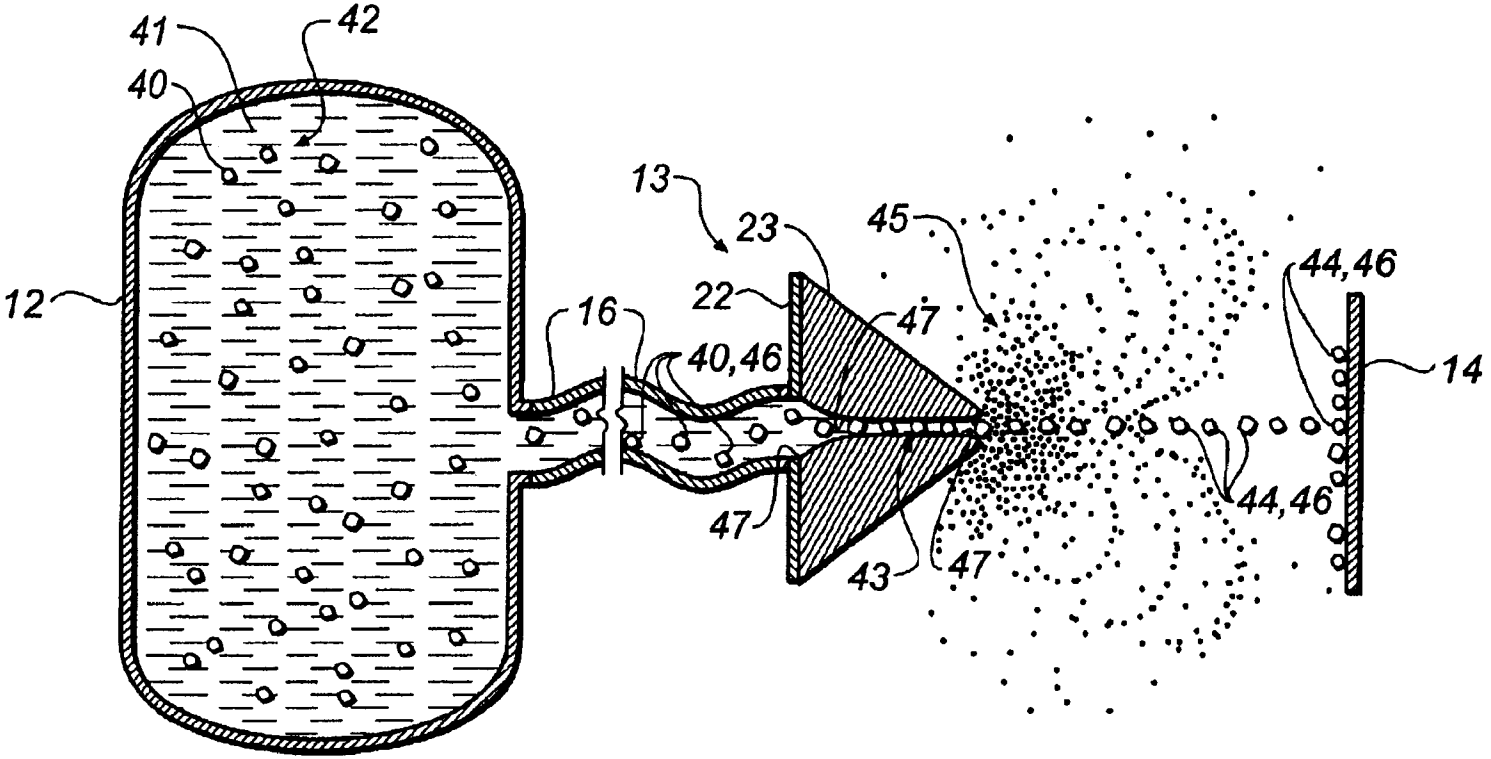

Operation of the delivery system 10 will now be described. FIGS. 3A–3D are diagrams schematically representing the operation of delivery system 10 and should not be considered as limiting the scope of the invention in any manner. A formulation 42 of functional material 40 in a supercritical fluid/compressed liquid/compressed gas 41 is prepared in the formulation reservoir 12. A functional material 40, any material of interest in solid or liquid phase, can be dispersed (as shown in FIG. 3A) and/or dissolved (similar to FIG. 3A except that functional material 40 would not be visible until the functional material 40 was caused to come out of solution) in a supercritical fluid, compressed gas, or compressed liquid 41 making a mixture or formulation 42. The functional material 40 can have various shapes and sizes depending on the type of the functional material 40 used in the formulation.

The supercritical fluid/compressed liquid/compressed gas 41, forms a continuous phase and functional material 40 forms a dispersed and/or dissolved single phase. The formulation 42 (the functional material 40 and the supercritical fluid/compressed liquid/compressed gas 41) is maintained at a suitable temperature and a suitable pressure for the functional material 40 and the supercritical fluid/compressed liquid/compressed gas 41 used in a particular application. The shutter 22 is actuated to enable the ejection of a controlled quantity of the formulation 42. The nozzle 23 collimates and/or focuses the formulation 42 into a beam 43.

The functional material 40 is controllably introduced into the formulation reservoir 12. The compressed liquid/supercritical fluid/compressed gas 41 is also controllably introduced into the formulation reservoir 12. The contents of the formulation reservoir 12 are suitably mixed using mixing device 70 to ensure intimate contact between the functional material 40 and compressed liquid/compressed gas/supercritical fluid 41. As the mixing process proceeds, functional material 40 is dissolved or dispersed within the compressed liquid/compressed gas/supercritical fluid 41. The process of dissolution/dispersion, including the amount of functional material 40 and the rate at which the mixing proceeds, depends upon the functional material 40 itself, the particle size and particle size distribution of the functional material 40 (if the functional material 40 is a solid), the compressed liquid/compressed gas/supercritical fluid 41 used, the temperature, and the pressure within the formulation reservoir 12. When the mixing process is complete, the mixture or formulation 42 of functional material and compressed liquid/compressed gas/supercritical fluid is thermodynamically stable/metastable in that the functional material is dissolved or dispersed within the compressed liquid/compressed gas/supercritical fluid in such a fashion as to be indefinitely contained in the same state as long as the temperature and pressure within the formulation chamber are maintained constant. This state is distinguished from other physical mixtures in that there is no settling, precipitation, and/or agglomeration of functional material particles within the formulation chamber unless the thermodynamic conditions of temperature and pressure within the reservoir are changed. As such, the functional material 40 and compressed liquid/compressed gas/supercritical fluid 41 mixtures or formulations 42 of the present invention are said to be thermodynamically stable/metastable.

The functional material 40 can be a solid or a liquid. Additionally, the functional material 40 can be an organic molecule, a polymer molecule, a metallo-organic molecule, an inorganic molecule, an organic nanoparticle, a polymer nanoparticle, a metallo-organic nanoparticle, an inorganic nanoparticle, an organic microparticles, a polymer microparticle, a metallo-organic microparticle, an inorganic microparticle, and/or composites of these materials, etc. After suitable mixing with the compressed liquid/compressed gas/supercritical fluid 41 within the formulation reservoir 12, the functional material 40 is uniformly distributed within a thermodynamically stable/metastable mixture, that can be a solution or a dispersion, with the compressed liquid/compressed gas/supercritical fluid 41. This thermodynamically stable/metastable mixture or formulation 42 is controllably released from the formulation reservoir 12 through the discharge device 13.

During the discharge process, the functional material 40 is precipitated from the compressed liquid/compressed gas/supercritical fluid 41 as the temperature and/or pressure conditions change. The precipitated functional material 44 is directed towards a receiver 14 by the discharge device 13 as a focussed and/or collimated beam. The particle size of the functional material 40 deposited on the receiver 14 is typically in the range from 1 nanometer to 1000 nanometers. The particle size distribution may be controlled to be uniform by controlling the rate of change of temperature and/or pressure in the discharge device 13, the location of the receiver 14 relative to the discharge device 13, and the ambient conditions outside of the discharge device 13.

The delivery system 10 is also designed to appropriately change the temperature and pressure of the formulation 42 to permit a controlled precipitation and/or aggregation of the functional material 40. As the pressure is typically stepped down in stages, the formulation 42 fluid flow is self-energized. Subsequent changes to the formulation 42 conditions (a change in pressure, a change in temperature, etc.) result in the precipitation and/or aggregation of the functional material 40 coupled with an evaporation (shown generally at 45) of the supercritical fluid/compressed gas/compressed liquid 41. The resulting precipitated and/or aggregated functional material 44 deposits on the receiver 14 in a precise and accurate fashion. Evaporation 45 of the supercritical fluid/compressed gas/compressed liquid 41 can occur in a region located outside of the discharge device 13. Alternatively, evaporation 45 of the supercritical fluid/compressed gas/compressed liquid 41 can begin within the discharge device 13 and continue in the region located outside the discharge device 13. Alternatively, evaporation 45 can occur within the discharge device 13.

A beam 43 (stream, etc.) of the functional material 40 and the supercritical fluid/compressed gas/compressed liquid 41 is formed as the formulation 42 moves through the discharge device 13. When the size of the precipitated and/or aggregated functional material 44 is substantially equal to an exit diameter of the nozzle 23 of the discharge device 13, the precipitated and/or aggregated functional material 44 has been collimated by the nozzle 23. When the size of the precipitated and/or aggregated functional material 44 is less than the exit diameter of the nozzle 23 of the discharge device 13, the precipitated and/or aggregated functional material 44 has been focused by the nozzle 23.

The receiver 14 is positioned along the path 16 such that the precipitated and/or aggregated functional material 44 is deposited on the receiver 14. Alternatively, the precipitated and/or aggregated functional material 44 can remove a portion of the receiver 14. Whether the precipitated and/or aggregated functional material 44 is deposited on the receiver 14 or removes a portion of the receiver 14 will, typically, depend on the type of functional material 40 used in a particular application.

The distance of the receiver 14 from the discharge assembly is chosen such that the supercritical fluid/compressed gas/compressed liquid 41 evaporates from the liquid and/or supercritical phase to the gas phase (shown generally at 45) prior to reaching the receiver 14. Hence, there is no need for subsequent receiver-drying processes. Further, subsequent to the ejection of the formulation 42 from the nozzle 23 and the precipitation of the functional material, additional focusing and/or collimation may be achieved using external devices such as electromagnetic fields, mechanical shields, magnetic lenses, electrostatic lenses etc. Alternatively, the receiver 14 can be electrically or electrostatically charged such that the position of the functional material 40 can be controlled.

It is also desirable to control the velocity with which individual particles 46 of the functional material 40 are ejected from the nozzle 23. As there is a sizable pressure drop from within the delivery system 10 to the operating environment, the pressure differential converts the potential energy of the delivery system 10 into kinetic energy that propels the functional material particles 46 onto the receiver 14. The velocity of these particles 46 can be controlled by suitable nozzle design and control over the rate of change of operating pressure and temperature within the system.

Figure 5A:
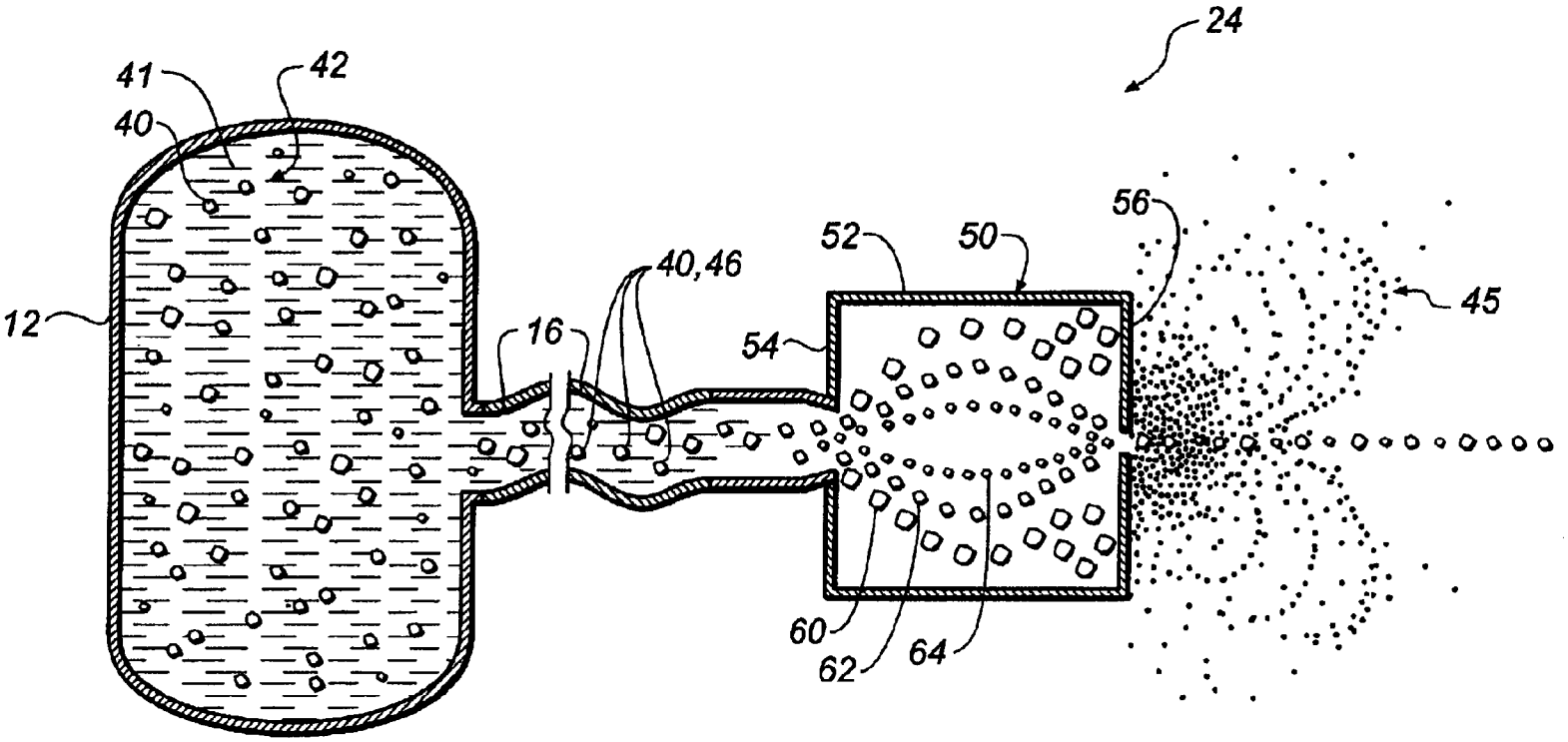
FIGS. 5A–5D are schematic views of the present invention including a beam control device.
Figure 5B:
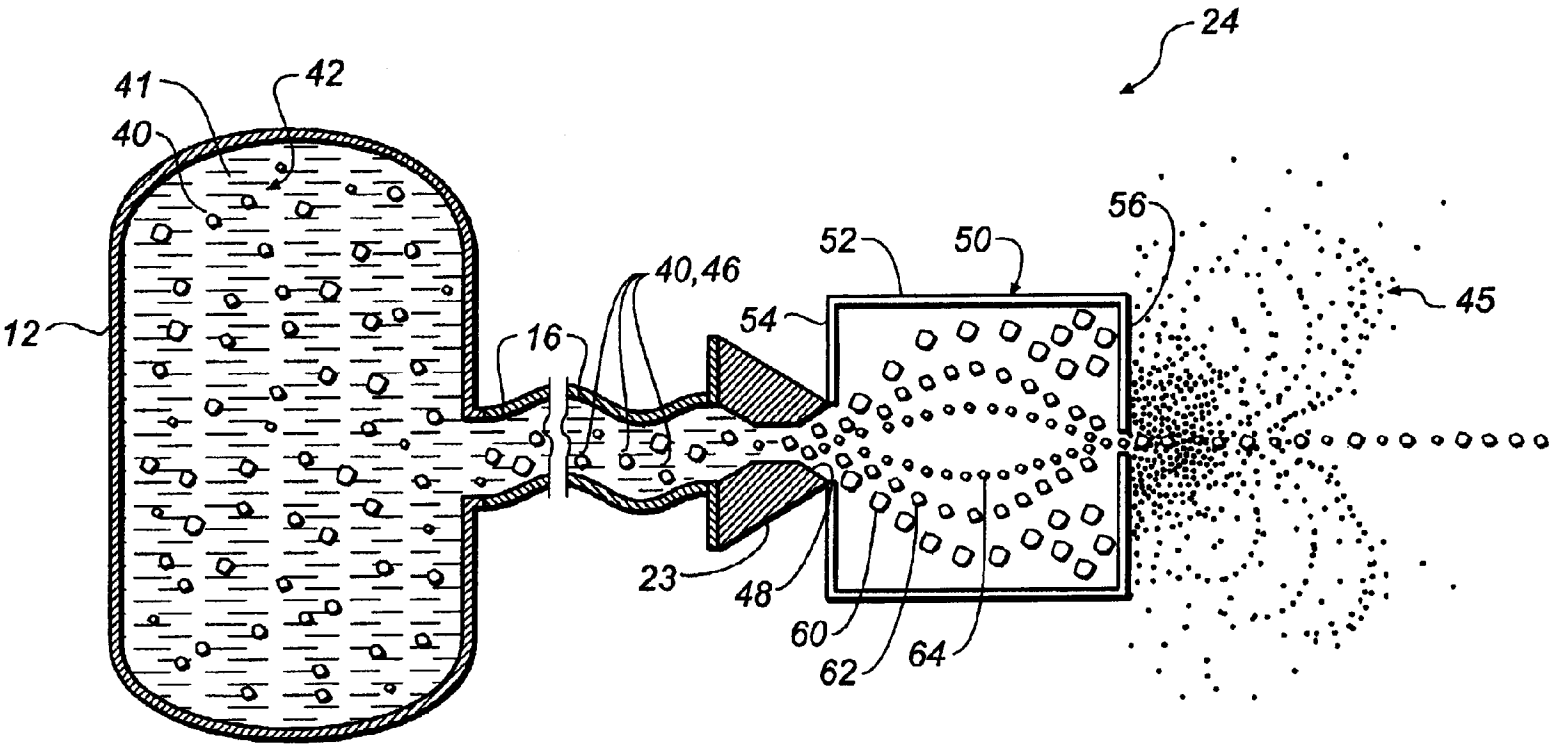
Figure 5C:
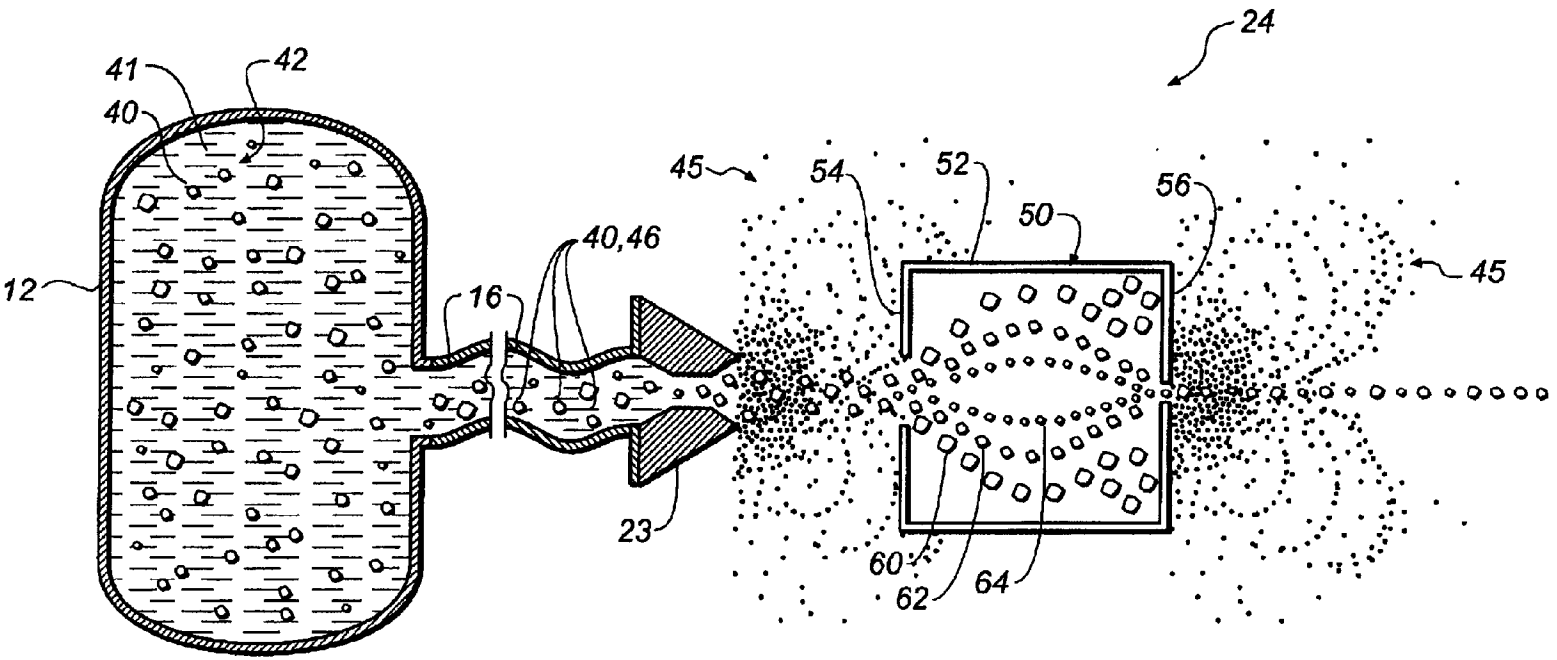

Referring to FIGS. 5A–5C, subsequent to the ejection of the formulation 42 from the nozzle 23 and the precipitation of the functional material 40, additional velocity regulation, focusing, and/or directioning of the functional material 40 can be achieved using the beam control device 24. The beam control device 24 includes devices such as catchers, stream deflectors, electromagnetic fields, mechanical shields, magnetic lenses, electrostatic lenses, aerodynamic lenses etc. The location of beam control device 24 can vary. The beam control device 24 can be part of the discharge device 13, either integrally formed or attached thereto. Alternatively, the beam control device 24 can be spaced apart from the discharge device 13.

When the beam control device 24 is an integral part of the discharge device 13, the functional material 40 is formed as the formulation moves through the beam control device 24. In this respect, the beam control device 24 can function as a focusing nozzle. As such, the nozzle 23 of the discharge device 13 can be replaced by the beam control device 24, as shown in FIG. 5A.

When additional focusing of the functional material is desired, the beam control device 24 can be positioned at the outlet 48 of the nozzle 23, as shown in FIG. 5B. When the beam control device 24 is positioned in this manner, the functional material 40 is formed as the formulation moves through the beam control device 24.

Alternatively, the beam control device 24 can be spaced apart from the nozzle 23 positioned in the material delivery path 16, as shown in FIG. 5C. When the beam control device 24 is positioned in this manner, the beam of functional material 40 is formed and then focused by passing it through the beam control device 24.

Figure 5D:
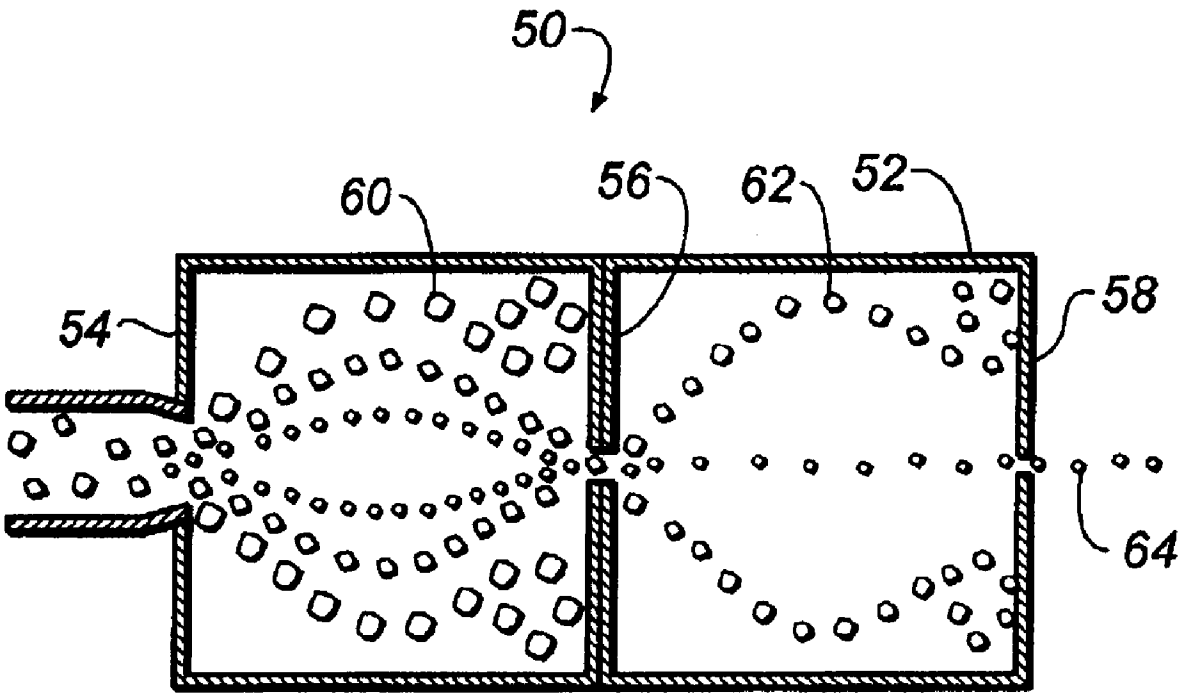

Again referring to FIGS. 5A–5C and referring to FIG. 5D, the beam control device 24 can be, for example, an aerodynamic lens 50. Aerodynamic lens 50 includes a tubular pipe (capillary, etc.) 52 having one or more orifice plates 54, 56, 58 with diameters smaller than the tubular pipe 52 positioned along the delivery path 16 such that additional focusing of the beam of functional material 40 occurs. Additional focusing occurs as the functional material 40 passes through the aerodynamic lens 50 because the orifice plates 54, 56, 58 are sized to prevent particles 60, 62 of functional material 40 from passing through the aerodynamic lens 50 (as shown in FIG. 5D) while particles 64 are permitted to pass through aerodynamic lens 50. In FIGS. 5A 5D, particles 60 and 62 are larger in size when compared to particles 64. The specific diameters of the orifice plates 54, 56, 58 will depend on the desired particle size of the functional material. Additional orifice plates can also be added depending on the desired particle size.

Alternatively, the aerodynamic lens 50 can include a first capillary tube of a given diameter in fluid communication with a second capillary tube of smaller diameter. These capillary tubes can also include one or more orifice plates with smaller diameters.

Figure 2G:
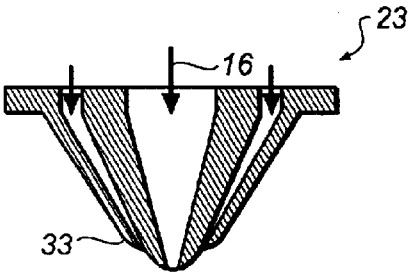
Figure 2H:
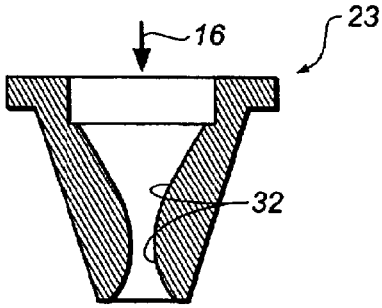
Figure 2I:
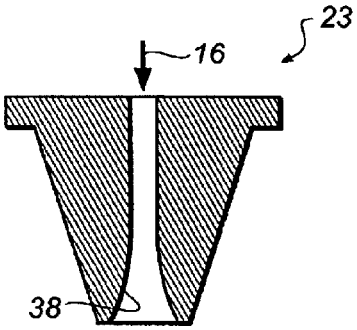
Figure 2J:
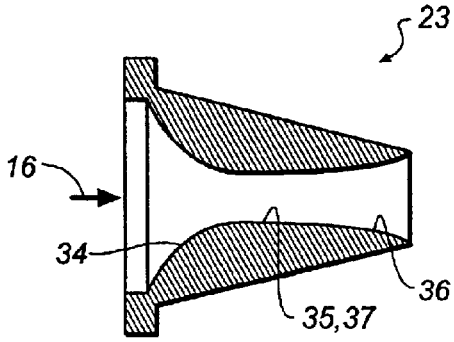

The nozzle 23 temperature can also be controlled. Nozzle temperature control may be controlled as required by specific applications to ensure that the nozzle opening 47 maintains the desired fluid flow characteristics. Nozzle temperature can be controlled through the nozzle heating module 26 using a water jacket, electrical heating techniques, etc. With appropriate nozzle design, the exiting stream temperature can be controlled at a desired value by enveloping the exiting stream with a co-current annular stream of a warm or cool, inert gas, as shown in FIG. 2G.

The receiver 14 can be any solid including an organic, an inorganic, a metallo-organic, a metallic, an alloy, a ceramic, a synthetic and/or natural polymeric, a gel, a glass, and a composite material. The receiver 14 can be porous or non-porous. Additionally, the receiver 14 can have more than one layer.

The invention has been described in detail with particular reference to certain preferred embodiments thereof, but it will be understood that variations and modifications can be effected within the scope of the invention.

What is claimed is:

1. An apparatus for delivering a functional material comprising:

a pressurized source of a thermodynamically stable mixture of a fluid and a functional material; and a discharge device having an inlet and an outlet, the discharge device being connected to the pressurized source at the inlet, the discharge device being shaped to produce a collimated beam of functional material, wherein the fluid is in a gaseous state at a location beyond the outlet of the discharge device.

2. The apparatus according to claim 1, wherein the fluid is a compressed liquid having a density equal to or greater than 0.1 grams per cubic centimeter.

3. The apparatus according to claim 1, wherein the fluid is a supercritical fluid having a density equal to or greater than 0.1 grams per cubic centimeter.

4. The apparatus according to claim 1, wherein the fluid is a compressed gas having a density equal to or greater than 0.1 grams per cubic centimeter.

5. The apparatus according to claim 1, wherein a particle size of the functional material is between 1 nanometer and 1000 nanometers.

6. The apparatus according to claim 1, further comprising:

a beam control device positioned proximate to the outlet of the discharge device, wherein the collimated beam of functional material is controlled after the collimated beam of functional material moves through the outlet of the discharge device.

7. The apparatus according to claim 6, wherein the beam control device is an aerodynamic lens attached to the outlet of the discharge device.

8. The apparatus according to claim 6, wherein the beam control device is an aerodynamic lens spaced apart from the outlet of the discharge device.

9. The apparatus according to claim 6, wherein the beam control device includes a tubular pipe having a diameter and at least one orifice plate positioned within the tubular pipe, the at least one orifice plate having a diameter smaller than the diameter of the tubular pipe.

10. A method of delivering a functional material comprising:

providing a pressurized source of a thermodynamically stable mixture of a fluid and a functional material; and causing the functional material to collimate by passing the thermodynamically stable mixture of the fluid and the functional material through a discharge device.

11. The method according to claim 10, further comprising:

causing the functional material to focus by passing the functional material through a beam control device.

* * * * *